US008316883B1

(12) United States Patent
Watson

(10) Patent No.: US 8,316,883 B1
(45) Date of Patent: Nov. 27, 2012

(54) WATER FAUCET TEMPERATURE GAUGE AND DISPLAY

(76) Inventor: Craig Watson, Castro Valley, CA (US)

( * ) Notice: Subject to any disclaimer, the term of this patent is extended or adjusted under 35 U.S.C. 154(b) by 326 days.

(21) Appl. No.: 12/720,427

(22) Filed: Mar. 9, 2010

Related U.S. Application Data

(60) Provisional application No. 61/209,435, filed on Mar. 9, 2009.

(51) Int. Cl.
*E03B 7/07* (2006.01)

(52) U.S. Cl. ..... 137/551; 137/315.12; 374/148

(58) Field of Classification Search ..... 137/551, 137/15.17, 315.12; 374/147, 148
See application file for complete search history.

(56) References Cited

U.S. PATENT DOCUMENTS

| | | | | |
|---|---|---|---|---|
| 3,952,594 | A * | 4/1976 | McMahan | 374/147 |
| 4,575,262 | A * | 3/1986 | Andersen | 374/147 |
| 4,630,940 | A * | 12/1986 | Ostertag et al. | 374/148 |
| 4,682,626 | A * | 7/1987 | Bergmann | 137/551 |
| 4,743,120 | A | 5/1988 | Bowen | |
| 4,854,498 | A | 8/1989 | Stayton | |
| 4,923,116 | A | 5/1990 | Homan | |
| 4,945,943 | A | 8/1990 | Cogger | |
| 5,358,177 | A | 10/1994 | Cashmore | |
| 5,577,660 | A | 11/1996 | Hansen | |
| 5,979,776 | A | 11/1999 | Williams | |
| 6,059,192 | A | 5/2000 | Zosimadis | |
| 6,343,619 | B1 | 2/2002 | Pruitt | |
| RE37,888 | E | 10/2002 | Cretu-Petra | |
| 7,004,623 | B2 * | 2/2006 | Nakagawa et al. | 374/158 |
| D525,345 | S | 7/2006 | Anderson | |
| 7,252,431 | B1 * | 8/2007 | Caramanna | 374/147 |
| 2006/0045167 | A1 * | 3/2006 | Pawlenko et al. | 374/148 |
| 2009/0106891 | A1 * | 4/2009 | Klicpera | 4/605 |

* cited by examiner

*Primary Examiner* — John K Fristoe, Jr.
*Assistant Examiner* — Time Aigbe
(74) *Attorney, Agent, or Firm* — Montgomery Patent & Design, LLC; Robert C. Montgomery; Joseph Yaksich

(57) ABSTRACT

A water faucet providing a digital temperature readout indicating the temperature of the water exiting the faucet is herein disclosed. The faucet provides a switch to change the display between Fahrenheit and Celsius and is powered by a small integral solar cell and an internal battery for periods of low ambient light. The display and corresponding circuitry is mounted inside of a waterproof enclosure which is removably mounted to the faucet spout by locking fasteners. The display is removable and allows for replacement or maintenance should it malfunction or break. During use, an internal thermocouple senses a change in temperature to activate the apparatus, thereby conserving energy. Such features are ideal for measuring the temperature of water used to wash hands or dishes to ensure compliance with health department requirements.

14 Claims, 5 Drawing Sheets

WATER FAUCET TEMPERATURE GAUGE AND DISPLAY

RELATED APPLICATIONS

The present invention was first described in and claims the benefit of U.S. Provisional Application No. 61/209,435 filed Mar. 9, 2009, the entire disclosures of which are incorporated herein by reference.

FIELD OF THE INVENTION

The present invention relates generally to water faucet assemblies, and in particular, to a faucet and display assembly adapted to present a user with real time data regarding the temperature of water flowing through the faucet.

BACKGROUND OF THE INVENTION

Conventional residential and commercial water faucets including both cold and hot water supplies are ubiquitous in modern society. The uses of such faucets vary greatly, and as a result, the required operating temperatures span a great range as well. Sanitary operations such as the washing of hands often require high temperatures for maximum efficiency, while other simple operations prefer the use of cold temperatures in order to conserve energy. In either case, risks are present in the form of injuries from excessively high temperatures and extreme discomfort as a result of temperatures both too high or too low.

Various attempts have been made to provide water supplies with temperature regulating means. Examples of these attempts can be seen by reference to several U.S. Pat. No. 4,743,120, issued in the name of Bowen, describes a water temperature sensor adapted for mounting on a conventional shower or the like.

U.S. Pat. No. 5,577,660, issued in the name of Hansen, describes a temperature sensing automatic faucet. The Hansen system includes a thermostat, valves, temperature monitoring, sensors, and the like to provide an automated temperature control system.

U.S. Pat. No. RE 37,888, issued in the name of Cretu-Petra, describes a water faucet with touchless controls. The Cretu-Petra device provides a complete automated system via proximity sensor actuation and an internal automated means for providing a consistent temperature of water.

Additionally, ornamental designs for a water faucet with temperature control features exist, particularly U.S. Pat. Nos. D 525,345. However, none of these designs are similar to the present invention.

While these devices fulfill their respective, particular objectives, each of these references suffer from one (1) or more of the aforementioned disadvantages. Many such systems are complicated and difficult or impossible to retrofit to existing residential systems. Also, many such systems do not provide an easy readout to a user for them to determine the current state of the system. Furthermore, many such systems are not suited for use with faucet systems with both hot and cold water inflows. In addition, many such systems are not detachable for simple cleaning, maintenance, or storage during periods of non-use. Accordingly, there exists a need for a water faucet temperature monitoring system without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide an apparatus adaptable to conventional residential water faucet assemblies which provides a user with easily viewable and reliable temperature data in a manner which is simple, retrofittable, selectively removable, and replaceable. Thus, the object of the present invention is to solve the aforementioned disadvantages and provide for this need.

To achieve the above objectives, it is an object of the present invention to provide a means for sensing a temperature of outlet water exiting from a faucet assembly and display the temperature to a user via an easy to read display assembly. The apparatus comprises a water temperature display assembly which is removably attached to a water faucet assembly.

Another object of the present invention is to comprise a conventional counter or sink-mounted water faucet with features such as a base, a spout, and hot and cold water valves and handles. The faucet assembly further provides removable electrical and mechanical attachment to the display assembly.

Yet still another object of the present invention is to comprise a base and mounting means which allow the faucet assembly to be mounted to a surface such as a sink, countertop, or the like in a conventional manner, replacing an existing faucet assembly.

Yet still another object of the present invention is to further comprise a protruding spigot attachment feature which provides a removable electrical and mechanical attachment means to the display assembly. The spigot attachment feature comprises a horizontal profile to the display assembly in order to discreetly conceal the removable functionality of the display assembly, thus deterring theft and the like.

Yet still another object of the present invention is to comprise a display assembly having a display screen, a solar cell, a control button, and a battery. The display assembly further comprises internal components necessary to sense and display a temperature of mixed water exiting from the spout.

Yet still another object of the present invention is to comprise a removable attachment means for the display assembly and to enable temperature measurement within either faucet assembly to be displayed upon the display assembly. The attachment feature further comprises gaskets to provide a safe waterproof seal about the electrical connectors.

Yet still another object of the present invention is to comprise a numeric display of the temperature of water flowing through the spout and a control button to provide a user with a means of switching between Fahrenheit and Celsius readings.

Yet still another object of the present invention is to comprise a solar panel which provides electrical current to charge an internal battery and power the apparatus.

The battery provides power to the temperature sensing and display functions of the apparatus during periods of low ambient light.

Yet still another object of the present invention is to provide an access door portion along a rear surface of the housing of the display assembly for the replacement of batteries.

Yet still another object of the present invention is to further comprise a circuit board which provides additional onboard components such as microprocessors, memory chips, display drivers, software and the like necessary for the processing and display of temperature data.

Yet still another object of the present invention is to comprise temperature sensors located within a probe well integral to a wall portion of both the cold water and hot water spouts. In a preferred embodiment, the temperature sensors comprise conventional thermocouple wires.

Yet still another object of the present invention is to provide a method of utilizing the device that provides a unique means of installing the faucet assembly in the location of an existing conventional sink or faucet, attaching the display assembly, providing real-time data regarding the temperature of water flowing through the system, and allowing a user to disconnect the display assembly during periods of non-use.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
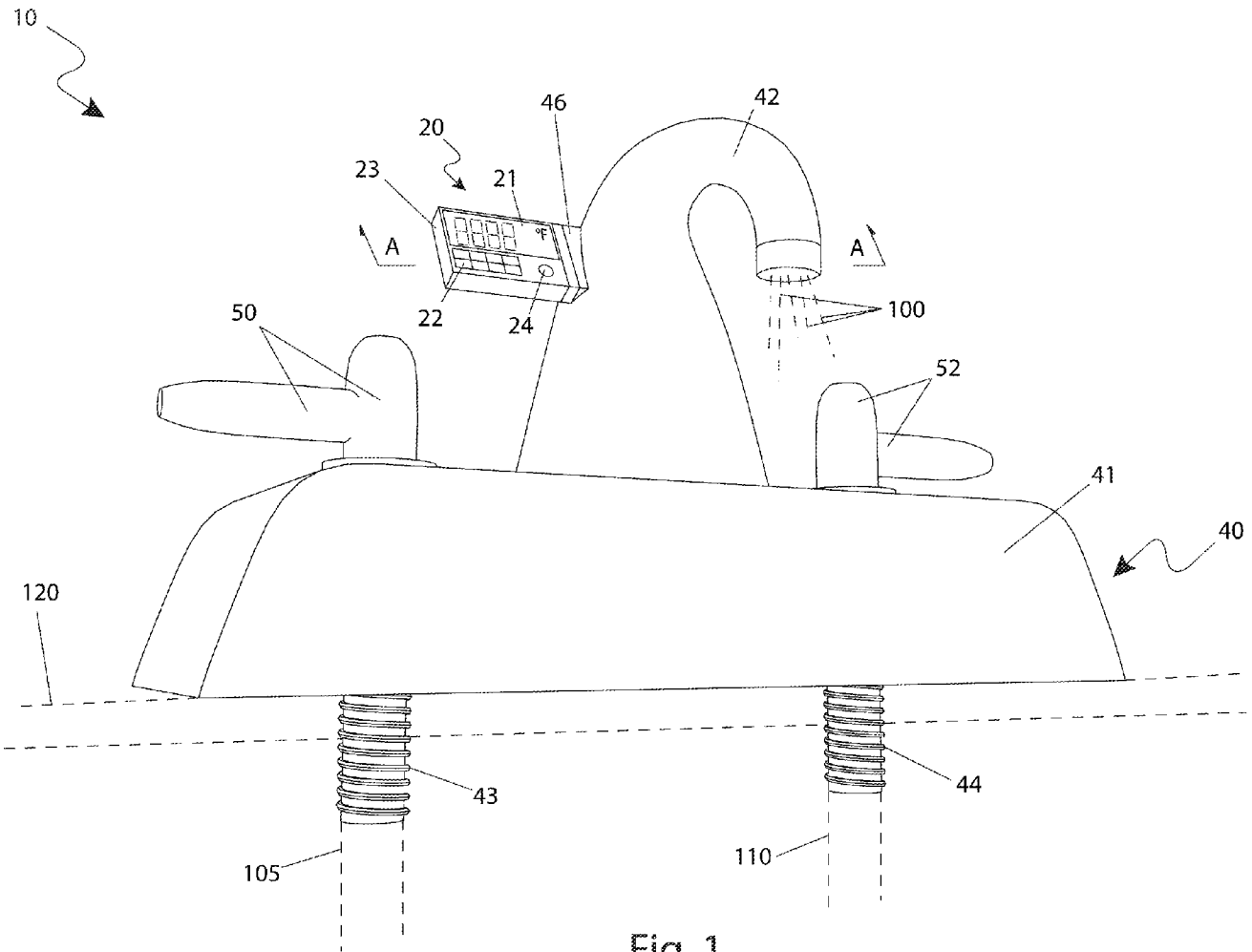
FIG. 1 is a front environmental view of a water faucet with integral temperature gauge and display 10, according to a preferred embodiment of the present invention.

| | |
|---|---|
| 10 | water faucet with integral temperature gauge and display |
| 20 | display assembly |
| 21 | digital display |
| 22 | solar cell |
| 23 | housing |
| 24 | control button |
| 25 | fastener aperture |
| 26 | battery |
| 28 | battery compartment |
| 30 | gasket |
| 40 | faucet assembly |
| 41 | base |
| 42 | spout |
| 43 | hot water inlet |
| 44 | cold water inlet |
| 46 | spigot attachment feature |
| 47 | insulation |
| 48 | locking fastener |
| 49 | probe well |
| 50 | hot water valve/handle |
| 52 | cold water valve/handle |
| 60 | first male connector |
| 62 | second male connector |
| 64 | first female connector |
| 66 | second female connector |
| 67 | thermocouple wire |
| 68 | wiring |
| 70 | circuit board |
| 72 | voltage regulator |
| 80 | alternate faucet assembly |
| 81 | alternate spigot base |

-continued

| | |
|---|---|
| 82 | alternate spout |
| 83 | alternate locking fastener |
| 84 | alternate hot water valve handle |
| 86 | alternate cold water valve handle |
| 88 | alternate spigot attachment feature |
| 89 | alternate probe well |
| 100 | water |
| 105 | hot water line |
| 110 | cold water line |
| 120 | mounting surface |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a water faucet with an integral temperature gauge and display (herein described as the "apparatus") 10, which provides a means for sensing a temperature of outlet water 100 exiting from a faucet assembly 40 and displaying said temperature to a user via an easy to read display assembly 20. The apparatus 10 is envisioned to provide a user an easy to install replacement faucet assembly 40 equipped with the display assembly 20 to provide accurate exiting water temperature while maintaining a pleasing aesthetic appearance.

Referring now to FIG. 1, a front environmental view of the apparatus 10, according to the preferred embodiment of the present invention, is disclosed. The apparatus 10 comprises a water temperature display assembly 20 being removably attached thereto a water faucet assembly 40. The faucet assembly 40 is envisioned to comprise expected features similar to other common commercially available counter or sink-mounted water faucets, such as a base 41, a spout 42, a hot water valve/handle 50, and a cold water valve/handle 52. Although illustrated here depicting a preferred embodiment, it is understood that said faucet assembly 40 may be introduced in various shapes, colors, designs, and materials which may utilize the teachings of the apparatus 10 enabling a user to decoratively match said faucet assembly 40 thereto a desired room décor while providing equal benefit and function (see FIG. 2).

The base 31 is envisioned to be mounted thereto a mounting surface 120 such as a sink, counter top, or the like in a conventional manner. The hot water valve/handle 50 and cold water valve/handle 52 are envisioned to be attached thereto an upper surface of said base 41 thereat opposing end portions. The hot water valve/handle 50 provides a variable flow control means to hot water from a connected hot water line 43 to the spout 42. In like manner, the cold water valve/handle 52 provides a variable flow means to cold water from a cold water line 44 to the spout 42. The control valve/handles 50, 52 are envisioned to be similar to other commercially available variable flow rate valves. The hot and cold water flow 100 is mixed internally within the faucet assembly 40 and the spout 42. Although illustrated here comprising two (2) control valve/handles 50, 52, it is understood that the faucet assembly 40 may be introduced in various designs including a single valve/handle configuration, and as such should not be viewed as a limiting factor of the apparatus 10.

The apparatus 10 provides removable attachment of the temperature display assembly 20 thereto a side surface portion of said spout 42 via a protruding spigot attachment feature 46 being cast or molded into the spout 42 preferably along a side surface. The spigot attachment feature 46 provides sealed and fixtured attachment of said temperature display assembly 20 thereto the spout portion 42. The display assembly 20 and spigot attachment feature 46 comprise similar horizontal profile shapes so as to discreetly conceal the removable functionality of the display assembly 20. When affixed thereto the spigot attachment feature 46, the temperature display assembly 20 extends horizontally from said spigot attachment feature 46, being ergonomically tilted therein a rearward orientation at an approximate angle of forty-five degrees (45°), thereby improving a user's viewing angle. The display assembly 20 provides a user a sealed electronic interface further comprising a display screen 21, a solar cell 22, and a control button 24. The display assembly 20 is further envisioned to comprise various colors, shapes, and physical design features which aesthetically match that of the faucet assembly 40, thereby providing a pleasant appearance thereto the entire apparatus 10.

Figure 4:
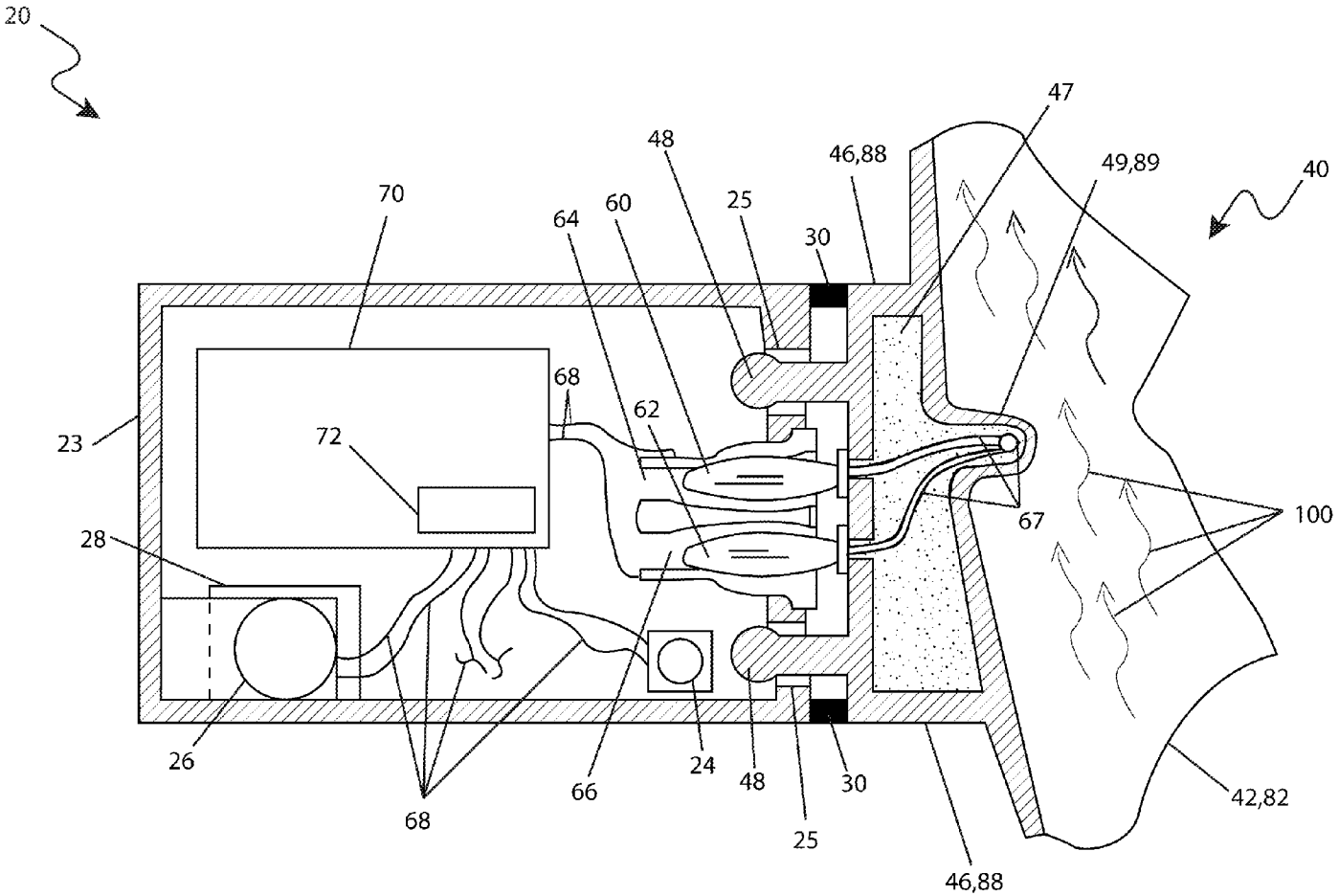
FIG. 4 is a section view of the water faucet with integral temperature gauge and display 10 taken along section line A-A (see FIG. 1), according to either embodiment of the present invention; and, FIG. 5 is an electrical block diagram of a water faucet with integral temperature gauge and display 10, according to either embodiment of the present invention.
Figure 5:
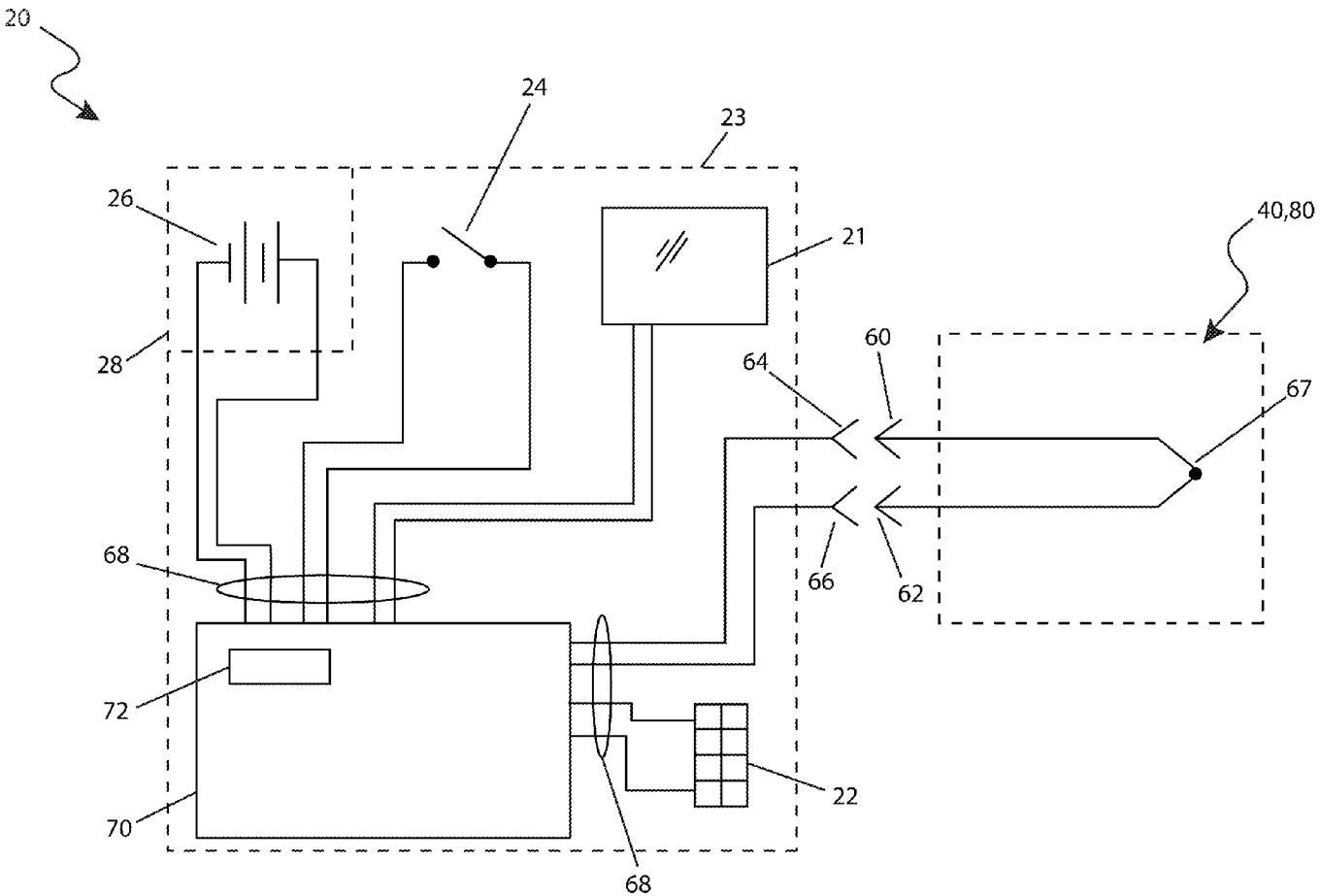

The display assembly 20 provides internal components necessary to sense and display a temperature of mixed water 100 exiting from the spout 42 (see FIGS. 4 and 5).

Figure 2:
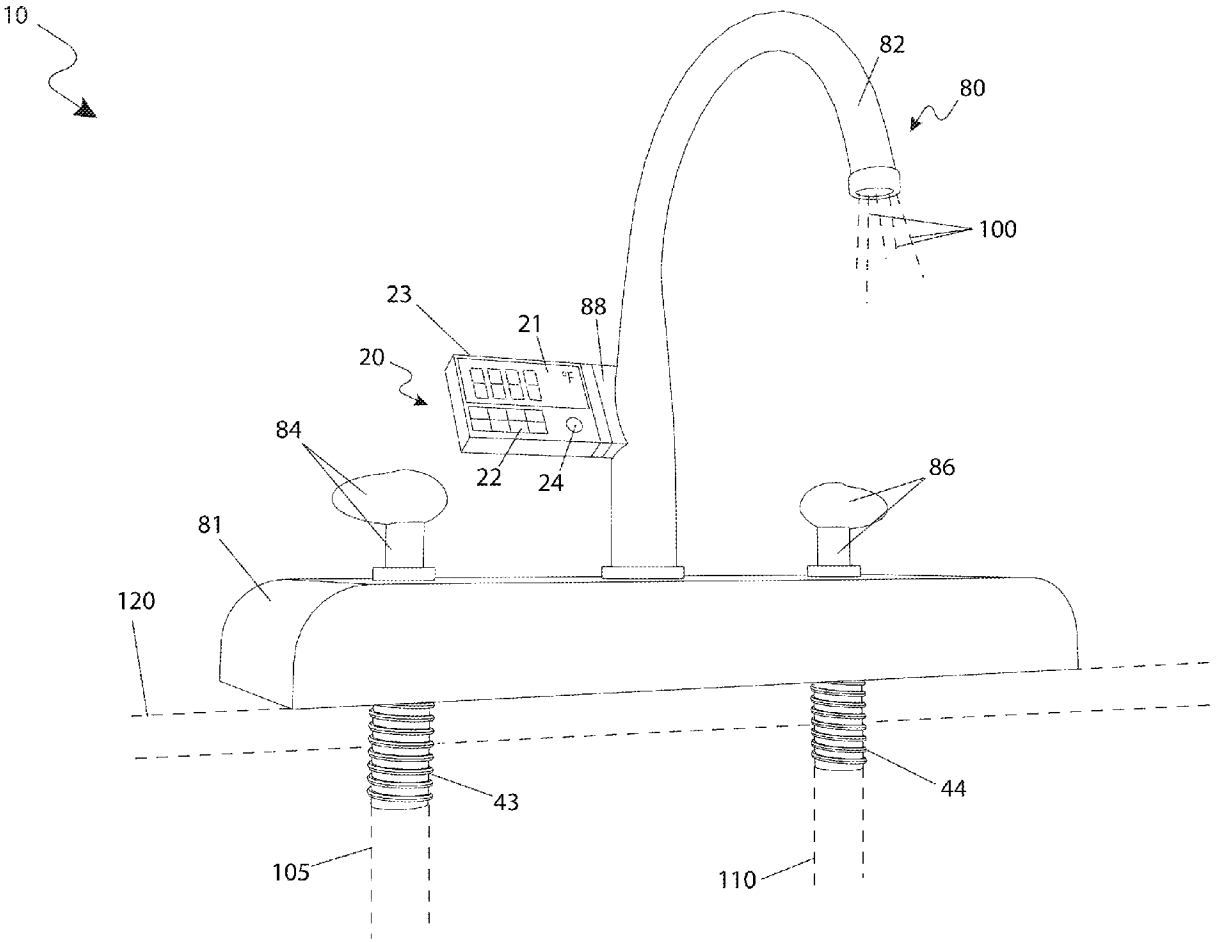
FIG. 2 is a front environmental view of a water faucet with integral temperature gauge and display 10 depicting an alternate spigot assembly 80, according to an alternate embodiment of the present invention.

Referring now to FIG. 2, a front environmental view of the apparatus 10 depicting an alternate faucet assembly 80, according to an alternate embodiment of the present invention, is disclosed. The alternate faucet assembly 80 comprises an alternate spigot base 81, an alternate spout 82, an alternate hot water valve/handle 84, an alternate cold water valve/handle 86, and an alternate spigot attachment feature 88. Said alternate faucet portions 81, 82, 84, 86, 88 provide similar construction, materials, and function as the previously described preferred embodiment 10. It is further understood that the integration of the display assembly 20 may be incorporated into additional faucet assembly designs and configurations in like manner, and as such should not be viewed as a limiting factor of the apparatus 10.

Figure 3:
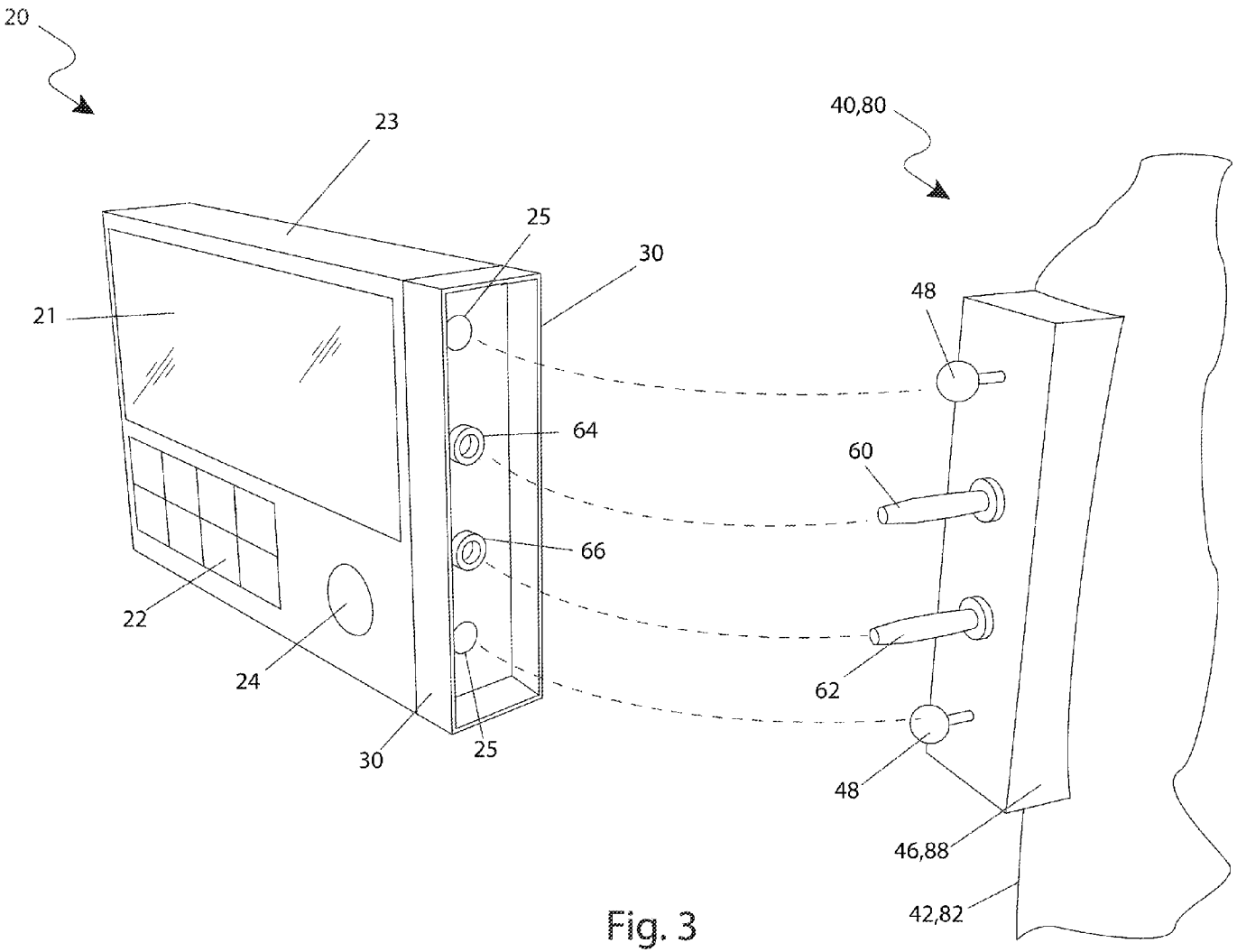
FIG. 3 is a close-up perspective view of a display assembly 20 and attachment means, according to either embodiment of the present invention.

Referring now to FIG. 3, a close-up perspective view of the display assembly 20 and attachment means, according to either embodiment of the present invention, is disclosed. Each spout portion 42, 82 provides removable attachment of the display assembly 20 via a pair of mechanically locking fasteners 48, 83 which are correspondingly engaged into mating fastener aperture portions 25 being molded into a side surface of the display assembly 20. Said locking fasteners 48, 83 comprise integrally-molded or fastened ball-end appendages being diametrically sized so as to result in an interference fit when engaged into the correspondingly positioned fastener apertures 25. As seen in FIG. 4, the locking fasteners 48, 83 pass through said fastener apertures 25 and protrude slightly into an inner space of the display assembly 20, thereby providing a secure snap-fit between. The display assembly 20 also comprises a rectangular sealing gasket 30 affixed thereto and extending from a side perimeter edge of said display assembly 20 which makes compressive contact therewith either spigot attachment feature 46 in a coplanar fashion along a vertical plane, thereby sealing the display assembly 20 against. The gasket 30 is envisioned to be made of soft rubber or equivalent sealing material and attached thereto said display assembly 20 using common industrial adhesives. The display assembly 20, gasket 30, and either spigot attachment feature 46, 88 all comprise similar horizontal profile shapes so as to discreetly conceal the removable functionality of the display assembly 20 to deter possible theft of the display assembly 20. The removal of said display assembly 20 provides a means for convenient cleaning, repairing, assembly replacement, battery replacement, or the like.

An electrical connection between the display assembly 20 and either spigot attachment feature 46, 88 is coincidentally established during the previously described mechanical joining thereof. Each spigot attachment feature 46, 88 comprises a first male connector 60 and a second male connector 62. Correspondingly, the display assembly 20 comprises a first female connector 64 and second female connector 66. During mechanical engagement of the aforementioned locking fasteners 48, 83 and fastener apertures 25, said male 60, 62 and female 64, 66 connectors are coincidentally engaged to establish electrical communication between the thermocouple wire portion 67 of either faucet assembly 40, 80 and the display assembly 20 (see FIG. 4). Said male 60, 62 and female 64, 66 connectors are envisioned to comprise commercially available heavy-duty banana-type connectors common in the industry and capable of numerous connection and disconnection cycles without loss of electrical performance. Electrical communication between either faucet assembly 40, 80 and the display assembly 20 enables temperature measurement within either faucet assembly 40, 80 to be displayed thereupon the display assembly 20 via internal electronic components (see FIGS. 4 and 5).

The display assembly 20 also comprises a digital display 21, a miniature solar panel 22, a housing 23, and a control button 24 along a front surface thereof. The housing 23 provides a protective water-resistant rectangular plastic enclosure thereto electrical and electronic equipment necessary thereto the operation of the apparatus 10 (see FIGS. 4 and 5). The display 21 provides numeric display of the temperature of the water 100 as it flows through either spout 42, 82. The solar panel 22 provides an electrical current to display the water temperature and/or to charge an internal battery 26 based upon available ambient light. The battery 26 subsequently powers the temperature sensing and displaying functions of the apparatus 10 during times of low ambient light. The control button 24 provides a switching means which converts the displayed water temperature into Fahrenheit or Celsius scales based upon a user's selection.

Referring now to FIG. 4, a section view of the apparatus 10 taken along section line A-A (see FIG. 1), according to either embodiment of the present invention, is disclosed. The display assembly 20 further comprises a miniature rechargeable battery 26, a battery compartment 28, interconnecting wiring 68, and a circuit board 70. The electric power received from the aforementioned solar panel 22 is conducted thereto a voltage regulator circuit 72 located upon the circuit board 70, which in turn conducts a charging voltage thereto the battery 26. The battery 26 is accessed in a conventional manner for replacement purposes via a battery compartment 28 having an access door portion along a rear surface of the housing 23.

The circuit board 70 also provides additional on-board components such as, but not limited to: microprocessors, memory chips, a display driver, and embedded executable software. The connection of the first 60 and second 62 male connectors therewith the first 64 and second 66 female connectors conducts a signal voltage from a thermocouple wire 67 within either spigot attachment feature 46, 88 thereto the circuit board 70 within the display assembly 20.

The apparatus 10 provides accurate temperature sensing capability within the water flow 100 via a thermocouple wire 67 located within a probe well 49, 89 integral thereto a wall portion of either spout 42, 82 adjacent thereto either spigot attachment feature 46, 88. The thermocouple wire 67 extends from said first 60 and second 62 male connectors, through either spigot attachment feature 46, 88 and into the probe well portion 49, 83 of either spout 42, 82. The measurement of the water temperature is accomplished preferably using a conventional thermocouple wire 67. The thermocouple wire 67 comprises two (2) wires made of different metals forming a junction, thereby conducting an electrical potential to the circuit board 70 to determine the temperature of the water 100. Said thermocouple wire 67 is held in close proximity to the flowing water 100 using a solidified insulating potting fluid 47 within the spigot attachment feature 46 and probe well 49.

The apparatus 10 is depicted here utilizing a thermocouple device 67, however, various other methods for detection and measurement of a water temperature may be provided without deviating from the concept, and as such should not be interpreted as a limiting factor of the apparatus 10.

Referring now to FIG. 5, an electrical block diagram of the apparatus 10, according to either embodiment of the present invention, is disclosed. The solar cell 22 comprises a standard photovoltaic cell which converts solar energy into electricity through a photovoltaic effect. The variable voltage electrical power produced by the solar cell 22 is conducted thereto a standard voltage regulator 72 envisioned to be located thereupon the circuit board 70, to maintain a constant output voltage to the circuit board and the battery 26. The battery 26 comprises a miniature standard replaceable or rechargeable cell which provides electrical power thereto the apparatus 10 during low light conditions. The internal circuit board 70 comprises suitable electronics to manage inputs and outputs to receive and communicate the temperature of the water 100 from the thermocouple 67 to the display 21. The control button 24 provides an input signal thereto the circuit board 70 enabling embedded software within said circuit board 70, to switch between degrees Fahrenheit and degrees Celsius and vice versa when engaged by a user. The thermocouple wire 67 measures the temperature of the outlet water 100 and in turn transmits an input signal thereto the circuit board 70 which provides a processing and displaying means thereto the digital display 21. The circuit board 70 is to display a measured temperature thereupon the digital display 21 for a predetermined period of time following a change in sensed water temperature, thereby remaining in an "off" state to conserve power when either faucet assembly 40, 80 is not being utilized to provide water 100. The display screen 21 is envisioned to be a standard backlit liquid crystal display (LCD) screen or equivalent display technology, providing a means of visually indicating the temperature of the outlet water 100. All electrical communication within the apparatus 10 is conducted via common electrical wiring 68.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 having either faucet assembly 40, 80, may be achieved by performing the following steps: preparing a mounting surface 120 such as a sink, counter top, or the like, for installation of either faucet assembly 40, 80; installing either faucet assembly 40, 80 thereto the mounting surface 120 in a conventional manner; connecting the hot water line 105 thereto the hot water inlet 43 using normal plumbing methods; connecting the cold water line 110 thereto the cold water inlet 44; attaching the display assembly 20 thereto either spigot attachment feature 46, 88 by engaging the locking fasteners 48 into the fastener apertures 25, if not previously installed; ensuring the locking fasteners 48 are securely engaged thereto the fastener apertures 25; enabling a water supply thereto the apparatus 10 by opening appropriate remote supply valves; opening either hot water valve/handle 50, 84 and either cold water valve/handle 52, 86 thus allowing the hot and cold water 100 to mix within either spout 42, 82 to produce an outlet water mixture 100; viewing the display 21 which is to indicate the temperature of the outlet water 100; manipulating the variable flow valve/handles 50, 84, 52, 86 until a desired outlet water 100 temperature is achieved; engaging the control button 24 to change the temperature display nomenclature from Fahrenheit to Celsius and visa versa, as desired; removing the display assembly 20 from either faucet assembly 40, 80, if necessary, by pulling the display assembly 20 horizontally to disengage the locking fasteners 48 from the fastener apertures 25; and, benefiting from an accurate display of outlet water 100 temperature from either faucet assembly 40, 80 afforded a user of the present apparatus 10.

The method of replacing the battery 26 may be accomplished by removing the door portion of the battery compartment 28; removing the spent battery 26 from the display housing 23; installing a fresh battery 26; and, replacing the access door of the battery compartment 28; and, resuming normal operation of the apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A combined water faucet and temperature gauge and display for sensing and displaying a temperature of outlet water exiting from said water faucet, said combined water faucet and temperature gauge and display comprising:

a faucet assembly having a base, a spout connected to said base, a hot water handle connected to said base, and a cold water handle connected to said base; and, a temperature display assembly attached to said faucet assembly and including a thermocouple wire, further comprising:

a protruding spigot attachment feature attached to said spout such that said temperature display assembly extends horizontally from said spigot attachment feature;

a housing;

a display screen attached to said housing;

a solar cell attached to said housing;

a control button attached to said housing; and, an internal battery located inside said housing;

wherein said temperature display assembly is attached to a side surface portion of said spout such that said thermocouple wire detects a temperature of water flowing through said faucet assembly;

wherein said temperature display assembly is tilted in a rearward orientation at an approximate angle of forty-five degrees relative to said spout thereby improving a user viewing angle;

wherein said spigot attachment feature comprises a pair of mechanically locking fasteners, and a plurality of fastener apertures formed in said housing, said locking fasteners being engaged with said fastener apertures and a side surface of said temperature display assembly;

wherein said locking fasteners comprise diametrically sized ball-end appendages engaged into said fastener apertures; and, wherein said locking fasteners are passed through said fastener apertures and protrude into an inner space of said display assembly and thereby provide a secure snap-fit.

2. The combined water faucet and temperature gauge and display of claim 1, wherein said temperature display assembly further comprises:

a sealing gasket affixed to a side perimeter edge of said temperature display assembly and thereby contacting said spigot attachment feature in a coplanar fashion along a vertical plane and thereby sealing said temperature display assembly.

3. The combined water faucet and temperature gauge and display of claim 2, wherein said spigot attachment feature is electrically connected to said temperature display assembly;

wherein said spigot attachment feature comprises a first male connector and a second male connector;

wherein said temperature display assembly comprises a first female connector and a second female connector;

wherein said first and second male connectors and said first and second female connectors are coincidentally engaged and establish electrical communication between said thermocouple wire of said faucet assembly and said temperature display assembly; and, wherein electrical communication between said faucet assembly and said temperature display assembly enables temperature measurement within said faucet assembly to be displayed on said temperature display assembly.

4. The combined water faucet and temperature gauge and display of claim 3, wherein said temperature display assembly provides numeric display of said water temperature as water flow through said spout;

wherein said solar panel provides an electrical current to display said water temperature as well as charge said internal battery; and, wherein said internal battery powers temperature sensing and displaying functions of said temperature display assembly during times of low ambient light.

5. The combined water faucet and temperature gauge and display of claim 4, wherein said temperature display assembly further comprises:

a circuit board located inside said housing and having a voltage regulator circuit;

a probe well portion located inside said spigot attachment feature; and, an insulating potting fluid located inside said spigot attachment feature;

wherein electric power received from said solar panel is conducted to said voltage regulator circuit which in turn conducts a charging voltage to said internal battery; and, wherein connection of said first and second male connectors with said first and second female connectors conducts a signal voltage from said thermocouple wire within said spigot attachment feature to said circuit board within said temperature display assembly.

6. The combined water faucet and temperature gauge and display of claim 5, wherein said thermocouple wire is located within said probe well integral to a wall portion of said spout adjacent to said spigot attachment feature;

wherein said thermocouple wire extends from said first and second male connectors through said spigot attachment feature and into said probe well portion of said spout; and, wherein said thermocouple wire is held in close proximity to the flowing water by using said insulating potting fluid within said spigot attachment feature and said probe well.

7. The combined water faucet and temperature gauge and display of claim 6, wherein said thermocouple wire measures said temperature of said outlet water and in turn transmits an input signal to said circuit board; and, wherein, following a change in sensed water temperature, said circuit board remains in an off state to conserve power when said faucet assembly is not being utilized to provide water.

8. A combined water faucet and temperature gauge and display for sensing and displaying a temperature of outlet water exiting from said water faucet, said combined water faucet and temperature gauge and display comprising:

a faucet assembly having a base, a spout connected to said base, a hot water handle connected to said base, and a cold water handle connected to said base; and, a temperature display assembly attached to said faucet assembly and including a thermocouple wire;

wherein said temperature display assembly is removably attached to a side surface portion of said spout such that said thermocouple wire detects a temperature of water flowing through said faucet assembly;

wherein said temperature display assembly further comprises:

a protruding spigot attachment feature attached to said spout such that said temperature display assembly extends horizontally from said spigot attachment feature;

a housing;

a display screen attached to said housing;

a solar cell attached to said housing;

a control button attached to said housing; and, an internal battery located inside said housing;

wherein said temperature display assembly is tilted in a rearward orientation at an approximate angle of forty-five degrees relative to said spout thereby improving a user viewing angle;

wherein said spigot attachment feature comprises a pair of mechanically locking fasteners, and a plurality of fastener apertures formed in said housing, said locking fasteners being engaged with said fastener apertures and a side surface of said temperature display assembly;

wherein said locking fasteners comprise diametrically sized ball-end appendages engaged into said fastener apertures; and, wherein said locking fasteners are passed through said fastener apertures and protrude into an inner space of said display assembly and thereby provide a secure snap-fit.

9. The combined water faucet and temperature gauge and display of claim 8, wherein said temperature display assembly further comprises:

a sealing gasket affixed to a side perimeter edge of said temperature display assembly and thereby contacting said spigot attachment feature in a coplanar fashion along a vertical plane and thereby sealing said temperature display assembly.

10. The combined water faucet and temperature gauge and display of claim 9, wherein said spigot attachment feature is electrically connected to said temperature display assembly;

wherein said spigot attachment feature comprises a first male connector and a second male connector;

wherein said temperature display assembly comprises a first female connector and a second female connector;

wherein said first and second male connectors and said first and second female connectors are coincidentally engaged and establish electrical communication between said thermocouple wire of said faucet assembly and said temperature display assembly; and, wherein electrical communication between said faucet assembly and said temperature display assembly enables temperature measurement within said faucet assembly to be displayed on said temperature display assembly.

11. The combined water faucet and temperature gauge and display of claim 10, wherein said temperature display assembly provides numeric display of said water temperature as water flow through said spout;

wherein said solar panel provides an electrical current to display said water temperature as well as charge said internal battery; and, wherein said internal battery powers temperature sensing and displaying functions of said temperature display assembly during times of low ambient light.

12. The combined water faucet and temperature gauge and display of claim 11, wherein said temperature display assembly further comprises:

a circuit board located inside said housing and having a voltage regulator circuit;

a probe well portion located inside said spigot attachment feature; and, an insulating potting fluid located inside said spigot attachment feature;

wherein electric power received from said solar panel is conducted to said voltage regulator circuit which in turn conducts a charging voltage to said internal battery; and, wherein connection of said first and second male connectors with said first and second female connectors conducts a signal voltage from said thermocouple wire within said spigot attachment feature to said circuit board within said temperature display assembly.

13. The combined water faucet and temperature gauge and display of claim 12, wherein said thermocouple wire is located within said probe well integral to a wall portion of said spout adjacent to said spigot attachment feature;

wherein said thermocouple wire extends from said first and second male connectors through said spigot attachment feature and into said probe well portion of said spout; and, wherein said thermocouple wire is held in close proximity to the flowing water by using said insulating potting fluid within said spigot attachment feature and said probe well.

14. The combined water faucet and temperature gauge and display of claim 13, wherein said thermocouple wire measures said temperature of said outlet water and in turn transmits an input signal to said circuit board; and, wherein, following a change in sensed water temperature, said circuit board remains in an off state to conserve power when said faucet assembly is not being utilized to provide water.

* * * * *